US005963082A

United States Patent [19]

Dick et al.

[11] Patent Number: 5,963,082

[45] Date of Patent: Oct. 5, 1999

[54] CIRCUIT ARRANGEMENT FOR PRODUCING A D.C. CURRENT

[75] Inventors: Burkhard Dick; Andreas Wichern, both of Hamburg, Germany

[73] Assignee: U.S. Philips Corporation, New York, N.Y.

[21] Appl. No.: 08/930,104

[22] PCT Filed: Mar. 11, 1997

[86] PCT No.: PCT/IB97/00238

§ 371 Date: Nov. 10, 1997

§ 102(e) Date: Nov. 10, 1997

[87] PCT Pub. No.: WO97/34211

PCT Pub. Date: Sep. 18, 1997

[30] Foreign Application Priority Data

Mar. 13, 1996 [DE] Germany ..... 196 09 831

[51] Int. Cl.[6] ..... G05F 1/10

[52] U.S. Cl. ..... 327/538; 327/513; 327/539; 323/312; 323/315

[58] Field of Search ..... 327/530, 538, 327/539, 512, 513; 323/312, 315

[56] References Cited

U.S. PATENT DOCUMENTS

| | | | |
|---|---|---|---|
| 4,987,370 | 1/1991 | Leussler et al. | 324/318 |
| 4,998,066 | 3/1991 | Wichern et al. | 324/322 |
| 5,235,277 | 8/1993 | Wichern | 324/318 |
| 5,262,713 | 11/1993 | Agiman | 323/315 |
| 5,459,457 | 10/1995 | Sharpe | 340/825.44 |
| 5,594,382 | 1/1997 | Kato et al. | 327/539 |
| 5,608,349 | 3/1997 | Dick | 327/553 |
| 5,619,152 | 4/1997 | Holtvoeth et al. | 327/110 |
| 5,648,741 | 7/1997 | Wichern | 327/513 |
| 5,801,581 | 9/1998 | Koizumi | 327/530 |

OTHER PUBLICATIONS

Gunawan et al., "A Culvature–Corrected Low–Voltage Bandgap Reference" IEEE Journal of Solid–State Circuits, vol, 28, No. 6, Jun. 1993.

*Primary Examiner*—Jung Ho Kim
*Attorney, Agent, or Firm*—Jack D. Slobod

[57] ABSTRACT

A circuit arrangement (16) for producing a D.C. current, includes a feedback loop for producing a reference current from an output terminal (27) with a negative temperature coefficient. The feedback loop includes a current-source stage (17, 18) which feeds a current mirror stage (19, 20, 21) in response to a measuring current supplied from a current bank (24, 25, 28, 29), which also produces the output reference current. The output of the current mirror stage (19, 20, 21) drives a working impedance formed by the main current path of a transistor 22, across which a control voltage is developed which is applied to a control input (23) of the current bank (24, 25, 28, 29). The circuit arrangement is advantageously combined with a reference current source (1) arranged as a bandgap circuit for producing a reference current on an output terminal (2) with a positive temperature coefficient, by enabling the user to select a current reference with either a positive or negative temperature coefficient. Further, the respective reference current outputs with positive and negative temperature coefficients, properly dimensioned, may be combined to provide an output current from a common output terminal (35) which is independent of temperature in a predefined temperature range.

13 Claims, 2 Drawing Sheets

CIRCUIT ARRANGEMENT FOR PRODUCING A D.C. CURRENT

BACKGROUND OF THE INVENTION

The invention relates to a circuit arrangement for producing a D.C. current.

For electronic circuit arrangements to be inserted into battery-operated devices, a lowest possible energy consumption is to be aimed at for economic and ecological reasons. Therefore, electronic circuits which are designed for operation with low supply voltages and low power consumption when in operation have become very important for such devices. In this respect, the energy supply provided by only a single battery cell is aimed at while a D.C. voltage converter for increasing the supply voltage is dispensed with. Under these conditions, an electronic circuit whose voltage is supplied in this manner is to remain operable without any limitations even with a supply voltage down to about 0.9 volt, while the nominal value of the supply voltage is set to 1 volt, for example. When taking the fact into account that for bipolar transistors the base-emitter voltages in the conductive state are typically about 0.7 volt, there is the necessity for the use mentioned above to create specific circuit configurations because, for example, many transistor circuits are capable of operating only with considerably higher supply voltages.

In many applications it is necessary to have stabilized D.C. currents as current references, while these stabilized D.C. currents are to be independent of variations of the supply voltage, so that, for example, variations of the voltage produced by the battery, caused by different charging conditions of the battery must not have any influence on the function of the powered electronic circuits.

OBJECTS AND SUMMARY OF THE INVENTION

It is an object of the invention to provide a circuit arrangement which can be used as a current reference, which circuit arrangement can be used for very low supply voltages, preferably around 0.9 volt, has a simple structure, shows a stable operating behavior and offers a reference current with a negative temperature coefficient.

According to the invention, this object is achieved by a circuit arrangement for producing a D.C. current, comprising

- a current-source stage, which is supplied on one input with a measuring current led via an input resistor, and which comprises a current source transistor whose base-emitter path is arranged in parallel with the input resistor and whose collector electrode forms an output of the current-source stage, on which output an output current is offered,
- a current mirror stage for mirror-inverting the output current of the current-source stage to a working impedance, on which working impedance a control voltage is produced in response to this output current,
- a current bank having a control input which is supplied with the control voltage, and having at least two outputs simultaneously controlled by the control voltage, on which outputs mutually proportional currents are offered of which a first current forms the measuring current.

At this point there is observed that from the article "A Curvature-Corrected Low-Voltage Bandgap Reference" published in IEEE Journal of Solid State Circuits", vol. 28, no. 6, June 1993, pages 667 to 670, more particularly, page 668, FIG. 3, a circuit arrangement for producing a D.C. current is known which is also provided as a supply voltage down to one volt. This circuit arrangement comprises an npn transistor whose base-emitter path is connected in parallel with a resistor which resistor is passed through by a part of a current flowing to a branch of a current bank. This branch of the current bank comprises a pnp transistor which is connected in the form of a current mirror circuit to a further pnp transistor arranged as a diode. This pnp transistor arranged as a diode is fed by a further npn transistor whose base electrode is connected to the collector electrode of the former npn transistor. This connection is fed by a current source.

It has appeared that the known circuit arrangement shows a great tendency to oscillate despite thorough compensation measures and is thus unsuitable for use as a current reference.

In the circuit arrangement according to the invention, a closed-loop control circuit is formed via the current source, the current bank and the current mirror stage, which control circuit provides an effective stabilization of the circuit arrangement. The circuit arrangement according to the invention can be used with a supply voltage down to about 0.9 volt without limitations as to its operability. It is of simple structure and produces a D.C. current with a negative temperature coefficient i.e. a D.C. current which decreases when the operating temperature of the circuit arrangement falls.

Preferably, the working impedance which is influenced by the current mirror stage for generating the control voltage for the current bank, is formed by the main current path of a transistor whose control electrode is supplied with a starting current at least for making the circuit arrangement operative. This starting current produces a current flow in the working impedance, which current flow comes from the control input of the current bank when a still currentless current mirror stage is taken into operation. As a result, output currents are produced on the simultaneously controlled outputs of the current bank, among other currents, the measuring current for the current-source stage. This current-source stage in its turn produces in the current mirror stage a current which then feeds the working impedance in operation. Moreover, the starting current is preferably used for setting the required impedance value (resistance value) of the working impedance for which purpose a substantially constant starting current is preferred. This starting current can be supplied by a supply current stage which is connected to the control electrode of the transistor that forms the working impedance.

The circuit arrangement according to the invention produces a D.C. current which decreases when the operating temperature of the circuit arrangement falls. The circuit arrangement according to the invention thus has a negative temperature coefficient. In the cases where a current reference with a negative temperature coefficient is desired, the circuit arrangement according to the invention is thus capable of producing the desired reference current. Alternatively, there is a need and possibility of having a (further) reference current source which produces a reference current with a positive temperature coefficient on its reference current output. In a further step, the values of the temperature coefficients may be made to match. If in that case the reference current output of the (further) reference current source having a positive temperature coefficient is connected to one (further) of the simultaneously controlled outputs of the current bank of the circuit arrangement according to the invention, which circuit arrangement then represents a reference current source having a negative temperature coefficient, the reference current having the positive temperature coefficient can be linearly combined with the current from said output of the current bank (having the negative temperature coefficient), to form an overall output current i.e. preferably by adding the currents together. Since the positive and negative temperature coefficients balance each other out when appropriately dimensioned, the overall output current can be independent of the temperature in a predefined temperature range. Preferably, a so-termed bandgap circuit may be selected as a reference current source which has a positive temperature coefficient. This reference current source, also denoted bandspace reference, which has a positive temperature coefficient derives its reference current from the bandspace voltage of the semiconductor material from which material the electronic components used therein are made.

Further advantageous embodiments of the circuit arrangement according to the invention are apparent from the dependent claims.

These and other aspects of the invention will be apparent from and elucidated with reference to the embodiments described hereinafter.

DETAILED DESCRIPTION OF THE PREFERRED EMBODIMENT

Figure 1:
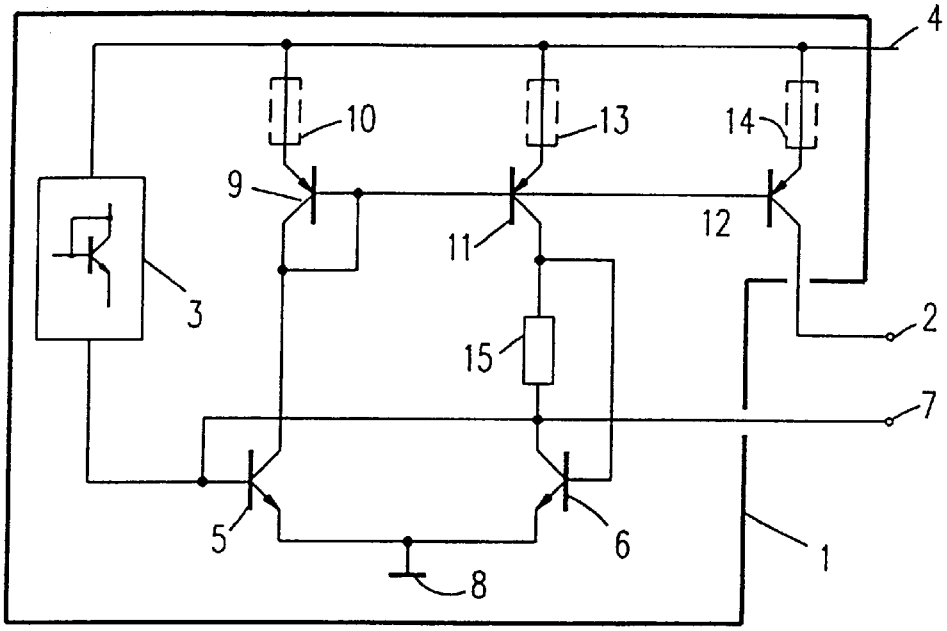
FIG. 1 shows an example for a so-termed bandgap circuit (bandspace reference)

FIG. 1 shows a reference current source 1 arranged as a bandgap circuit (bandspace reference) for offering a reference current having a positive temperature coefficient on a reference current output 2. The reference current source 1 comprises a start-up circuit 3 arranged as a dipole and connected, on the one hand, to a power supply terminal 4 and, on the other hand, to the base of a first one of two emitter-coupled npn transistors 5, 6. The base of this first npn transistor 5 is furthermore connected to the collector of the second npn transistor 6 and to a supply current output 7 of the reference current source 1. The emitters of the npn transistors 5, 6 are connected to ground 8. The collector of the first npn transistor 5 is connected to the collector of a diode-arranged first pnp transistor 9 whose emitter—via an emitter resistor 10, as required—is connected to the power supply terminal 4. The first pnp transistor 9 is connected with its base to the bases of two further pnp transistors 11, 12, whose emitters—via further emitter resistances 13, 14, as required—are also connected to the power supply terminal 4. The pnp transistors 9, 11, 12 thus form a current mirror circuit which is controlled by the first pnp transistor. The collector of the second pnp transistor 11 is connected via a resistor 15 to the collector of the second npn transistor 6 and thus to the supply current output 7. Furthermore, there is a line between the collector of the second pnp transistor 11 and the base of the second npn transistor 6. The collector of the third pnp transistor 12 of the current mirror circuit forms the reference current output 2 of the reference current source 1. The start-up circuit 3, which includes an npn transistor arranged as a diode, is thus preferably arranged as a diode between the power supply terminal 4 and the base of the first npn transistor 5.

With supply voltages on the power supply terminal 4 down to about 0.9 volt, the reference current source shown in FIG. 1 supplies a reference current from output 2 which increases as operating temperature rises.

Figure 2:
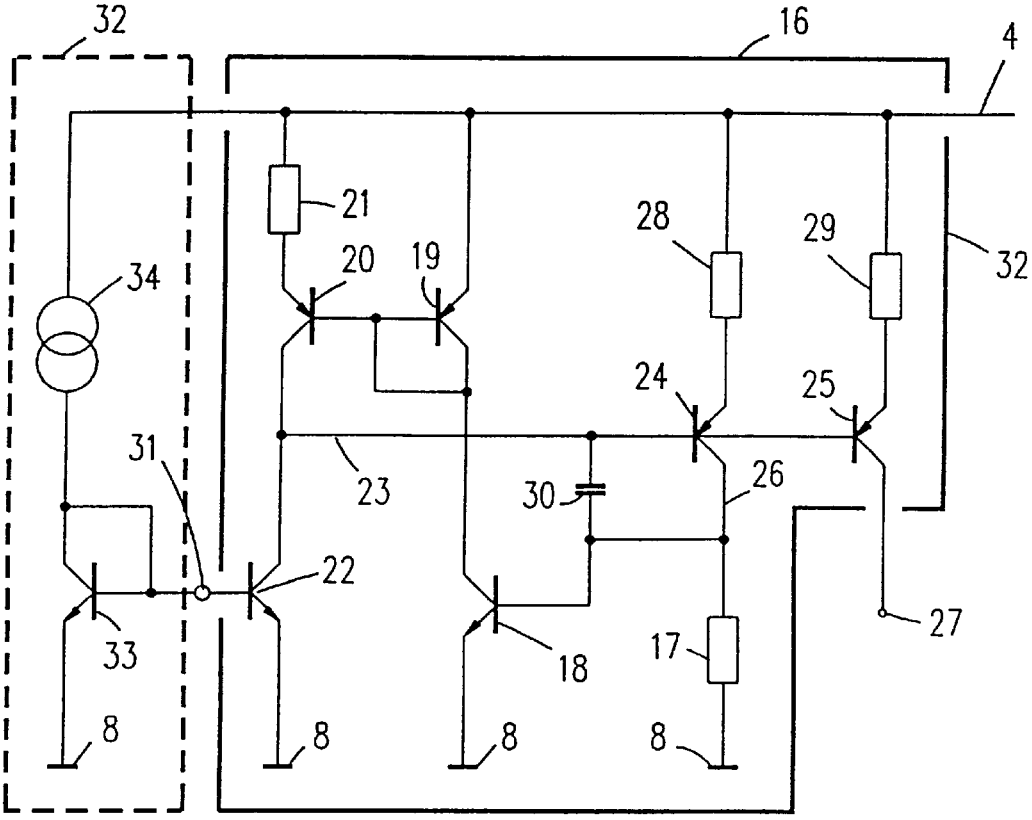
FIG. 2 shows an exemplary embodiment for a circuit arrangement according to the invention for producing a D.C. current having a negative temperature coefficient.

The exemplary embodiment of a circuit arrangement 16 according to the invention shown in FIG. 2 for producing a D.C. current with a negative temperature coefficient comprises a current-source stage which includes an input resistor 17 and a current source transistor 18. A terminal of the input resistor 17 and the emitter of the current source transistor 18 arranged as an npn transistor are connected to ground 8, the base of the current source transistor 18 and the second terminal of the input resistor 17 are connected to each other. The collector of the current source transistor 18 is connected to the collector and the base of a pnp transistor 19 arranged as a diode, whose emitter is connected to the power supply terminal 4. The pnp transistor 19, together with a further pnp transistor 20, forms a current mirror stage. For this purpose, the bases of the pnp transistors 19 and 20 are connected to each other. The emitter of the pnp transistor 20 is also connected to the power supply terminal 4 via an ohmic stabilization resistor 21. While the collector of the pnp transistor 19 forms the input of the current mirror stage, the collector of the further pnp transistor 20 forms its output. This output is connected to ground 8 via the collector-emitter path of an npn transistor 22 forming a working impedance.

The node between the collectors of the transistors 20 and 22 at the same time forms a control input 23 of a current bank which comprises two pnp transistors 24, 25, whose bases are connected to the control input 23 and whose collectors form two simultaneously controlled outputs 26, 27 of the current bank. The first simultaneously controlled output 26 i.e. the collector of the first pnp transistor 24 of the current bank is connected to the node between the input resistor 17 and the current source transistor 18, that is, to the input of the current-source stage. The emitters of the pnp transistors 24, 25 of the current bank are connected to the power supply terminal 4 by a respective emitter resistor 28, 29. A stabilization capacitor 30 is inserted between the control input 23 of the current bank 24, 25 and the input of the current-source stage 17, 18, that is, the output 26 of the current bank 24, 25.

The described circuit arrangement 16 forms a closed-loop control circuit comprising the current-source stage 17, 18, the current mirror stage 19, 20 and the current bank 24, 25. This closed-loop control circuit controls the D.C. current having the negative temperature coefficient coming from the second output 27 of the current bank 24, 25. The second output 27 of the current bank 24, 25 thus forms the output of the circuit arrangement 16. A measuring current on the first output 26 of the current bank 24, 25, that is, on the collector of the first pnp transistor 24 of this current bank, and proportional to this D.C. current, flows through the input resistor 17 of the current-source stage when the circuit arrangement 16 is in operation. The measuring current causes a voltage to occur in the input resistor 17 which voltage controls the collector current of the current source transistor 18, which collector current forms the output current of the current-source stage 17, 18. The output current of the current-source stage 17, 18 at the same time represents the input current of the current mirror stage 19, 20 and is mirror-inverted to the working impedance 22 by this current mirror stage. The current (output current of the current mirror stage) produced by the current mirror stage 19, 20 causes a control voltage to be developed on this working impedance, which control voltage controls the current bank 24, 25 and thus its output currents on the outputs 26, 27 via the control input 23, thus also the measuring current.

The ohmic stabilization resistor 21 in the current path for the current conveyed from the current mirror stage 19, 20 to the working impedance 22 and the stabilization capacitor 30 are (additionally) used for the stable operating behavior of the circuit arrangement 16 i.e. to further suppress any oscillatory tendencies.

In FIG. 2, the transistor 22 forming the working impedance is connected to a supply current stage 32 with its control electrode serving as a base 31. This supply current stage comprises a diode-arranged npn transistor 33 whose emitter is connected to ground and whose base is connected to the control electrode 31. The base of the npn transistor 33 is further connected to the collector of the npn transistor 33 and to a terminal of a constant-current source 34 which is also connected to the current supply terminal 4. The constant-current source 34 supplies current to the main current path, i.e. the collector-emitter path of the npn transistor 33 and to the control electrode 31 of the working impedance 22. When the circuit arrangement 16 is taken into operation i.e. when a supply voltage is applied to the power supply terminal 4, the constant-current source 34 produces a current in the working impedance 32 via the control electrode 31. In the current bank 24, 25, this current causes both a measuring current to occur on the output 26 and a D.C. current to occur on the output 27. The measuring current then puts the closed-loop control circuit forming the circuit arrangement 16 into operation via the current-source stage 17, 18 and the current mirror stage 19, 20. Once the circuit arrangement 16 has reached the operating state, the constant current produced by the constant-current source 34 provides a stable setting of the working impedance 22. In this state of operation, the starting current applied to the control electrode 31 works longer than the period in which the circuit arrangement 16 is put into operation.

Figure 3:
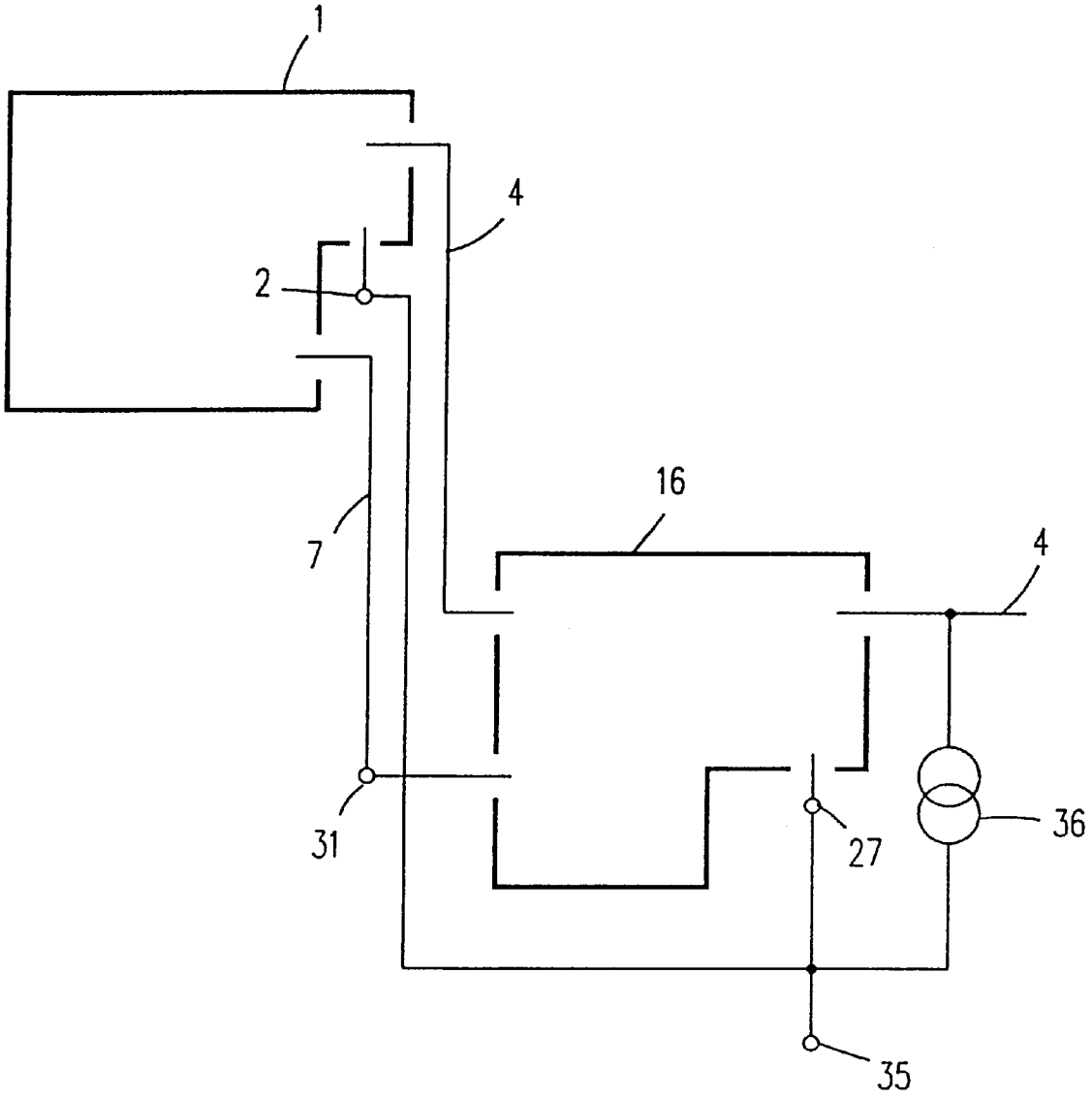
FIG. 3 shows a circuit arrangement for producing a temperature-independent D.C. current in a predefined temperature range.

FIG. 3 shows in a diagram a connection of the reference current source 1 shown in FIG. 1 with the circuit arrangement 16 for the production of a D.C. current with a negative temperature coefficient as shown in FIG. 2, the circuit elements already described again having like reference characters. The reference current source I and the circuit arrangement 16 are connected to the same current supply terminal 4. To supply a reference current having a positive temperature coefficient, the reference current output 2 of the reference current source 1 is connected to the output 27 of the D.C. circuit arrangement 16 having a negative temperature coefficient at a common output 35, at which a summed output current as a result of a linear combination, in the present example an addition, of the reference current and the current from the output 27 of the current bank 24, 25, is formed. Reference current source 1 and circuit arrangement 16 are then preferably dimensioned in such a way that the total output current on the common output 35 is independent of temperature in a predefined temperature range.

Further to the configuration shown in FIG. 3, the supply current output 7 is connected to the control electrode 31 for supplying the starting current for the working impedance 22 from the reference current source 1, while this starting current is maintained for setting the operating point of the working impedance 22 after the period of time necessary for taking the configuration into operation. In the configuration shown in FIG. 3 compared with that of FIG. 2, the supply current stage 32 is omitted and the reference current source 1 takes over a double function.

The example shown in FIG. 3 comprises a further constant-current source 36 inserted between the power supply terminal 4 and the common output 35, which constant-current source can superpose an additional constant current on the total output current.

The circuit configuration shown in FIG. 3 may advantageously be used as a current reference for a crystal oscillator which is driven by a nominal supply voltage of 1 volt and is used in a radio pager (pager).

We claim:

1. A circuit arrangement for producing a D.C. current, comprising a current-source stage, which is supplied on one input with a measuring current led via an input resistor, and which comprises a current source transistor whose base-emitter path is arranged in parallel with the input resistor and whose collector electrode forms an output of the current-source stage, on which output an output current is offered, a current mirror stage for mirroring the output current of the current-source stage to a working impedance, on which working impedance a control voltage is produced in response to this output current, a current bank having a control input which is supplied with the control voltage, and having at least first and second outputs simultaneously controlled by the control voltage, on which first and second outputs mutually proportional currents are offered, the current from the first output forming the measuring current.

2. A circuit arrangement as claimed in claim 1, characterized in that the working impedance is formed by the main current path of a transistor whose control electrode is supplied with a starting current at least for taking the circuit arrangement into operation.

3. A circuit arrangement as claimed in claim 2, characterized in that the control electrode of the transistor arranged as the working impedance is connected to a supply current stage.

4. A circuit arrangement as claimed in claim 3, characterized in that the supply current stage comprises a diode-arranged transistor and a constant-current source, which constant-current source applies a current to the main current path of the diode-arranged transistor and to the control electrode of the transistor forming the working impedance, the two said transistors being connected to each other by their control electrodes.

5. A circuit arrangement as claimed in claim 1, characterized by a reference current source which supplies on its reference current output a reference current having a positive temperature coefficient, the reference current output being connected to the second output of the current bank for forming an overall output current by linearly combining the reference current with the current from said second output of the current bank.

6. A circuit arrangement as claimed in claim 5, characterized in that the reference current source is a bandgap circuit.

7. A circuit arrangement as claimed in claim 5, characterized in that the reference current source is dimensioned so that the overall output current is temperature-independent in a predefined temperature range.

8. A circuit arrangement as claimed in claim 1, characterized by a stabilization capacitance which is inserted between the control input of the current bank and the input of the current-source stage.

9. A circuit arrangement as claimed in claim 1, characterized by an ohmic stabilizing resistance in the current path for the current led from the current mirror stage to the working impedance.

10. A circuit arrangement as claimed in claim 2, characterized by a reference current source which supplies on its reference current output a reference current having a positive temperature coefficient, the reference current output being connected to the second output of the current bank for forming an overall output current by linearly combining the reference current with the current from said second output of the current bank.

11. A circuit arrangement as claimed in claim 3, characterized by a reference current source which supplies on its reference current output a reference current having a positive temperature coefficient, the reference current output being connected to the second output of the current bank for forming an overall output current by linearly combining the reference current with the current from said second output of the current bank.

12. A circuit arrangement as claimed in claim 11, characterized in that the reference current source has a supply current output which is connected to the control electrode of the transistor forming the working impedance to supply the starting current.

13. A circuit arrangement as claimed in claim 10, characterized in that the reference current source has a supply current output which is connected to the control electrode of the transistor forming the working impedance to supply the starting current.

* * * * *